United States Patent [19]

King et al.

[11] Patent Number: 4,691,144

[45] Date of Patent: Sep. 1, 1987

[54] STAGGERED REFRESH PULSE GENERATOR FOR A TFEL PANEL

[75] Inventors: Christopher N. King, Portland; Brian J. Dolinar, Lake Oswego; William A. Barrow, Beaverton; Robert T. Flegal, Beaverton; Paul E. Gulick, Beaverton; Laurin G. Blacken, Wilsonville, all of Oreg.

[73] Assignee: Planar Systems, Inc., Beaverton, Oreg.

[21] Appl. No.: 821,464

[22] Filed: Jan. 22, 1986

[51] Int. Cl.[4] ..... G09G 3/30

[52] U.S. Cl. ..... 315/169.3; 315/169.2; 340/805; 340/760; 340/781

[58] Field of Search ..... 340/781, 803, 805, 825.81, 340/720, 811, 812; 315/169.4, 169.2, 169.3; 382/50

[56] References Cited

U.S. PATENT DOCUMENTS 4,479,120 10/1984 Ohba et al. ..... 340/781

FOREIGN PATENT DOCUMENTS 2096814A 10/1982 United Kingdom ..... 315/169

*Primary Examiner*—David K. Moore
*Assistant Examiner*—Mark R. Powell
*Attorney, Agent, or Firm*—Chernoff, Vilhauer, McClung & Stenzel

[57] ABSTRACT

A TFEL panel includes orthogonally disposed sets of scanning and data electrodes. The scanning electrodes are strobed with a preconditioning voltage and data is provided to selected data electrodes simultaneously with the line by line strobing of the scanning electrodes. A refresh pulse is applied to the screen once per frame of data at times which vary from frame to frame. This may be accomplished either by varying the time of occurrence of the refresh pulse within each frame or by holding the time of occurrence of the refresh pulse constant and varying the strobing sequence of the scanning electrodes. This technique prevents certain portions of the screen from generating a latent image due to charge accumulation which would otherwise result from the timing asymmetry between the scanning of certain electrodes and the fixed timing of the refresh pulse.

15 Claims, 11 Drawing Figures

SCANNING SEQUENCE

| | FRAME 1 | FRAME 2 | FRAME 3 | FRAME 4 |
|---|---|---|---|---|
| ROW | 1,2,3,4 | 3,1,4,2 | 4,3,2,1 | 2,4,1,3 |

STAGGERED REFRESH PULSE GENERATOR FOR A TFEL PANEL

BACKGROUND OF THE INVENTION

The present invention relates to thin film electroluminescent (TFEL) panels which include a layer of electroluminescent material sandwiched between dielectric plates containing orthogonally disposed electrodes to form a matrix of pixels.

TFEL panels may conventionally comprise a matrix of pixels formed by the intersections of a plurality of row electrodes and a plurality of column electrodes. These electrodes are situated on plates disposed on either side of a thin electroluminescent layer of material such as zinc sulfide. The row electrodes are energized in turn, usually from the top of the screen to the bottom, once per frame with a voltage often termed a "write" voltage. Simultaneously with the energization of each row electrode with the write voltage, selected column electrodes are energized with a modulation voltage which raises the potential across the electroluminescent film to a level above its threshold of luminescence, thus illuminating selected pixels in that row. Once all the rows have been energized in this fashion, a frame of data is completed. At the end of a frame of data it is necessary to remove the accumulated charge across the screen. This is accomplished by applying a "refresh" voltage pulse to all of the row electrodes simultaneously at the end of a frame of data. The refresh pulse is opposite in polarity to that of the write voltage pulse and is approximately equal in amplitude to the combination of the write voltage pulse plus the modulation voltage pulse. A typical driving architecture for such a system is described in copending patent application No. 729,974 which is assigned to the same assignee.

Over an extended period of time a phenomenon common to TFEL screens takes place in which certain parts of the screen age faster than others. This aging phenomenon is due primarily to a concentration of charge at the internal interfaces of the electroluminescent film and the dielectric layers. The charge accumulation is caused by the time asymmetry between the write and the refresh pulses. It has been observed that the differential aging effect is most pronounced at the top and at the bottom of the screen where the time asymmetry is at a maximum. In the center of the screen the differential aging effect is at a minimum because the timing of the write and refresh pulses is very nearly symmetrical. That is, the row electrodes in the center of the screen are alternately charged with the write voltage about halfway through the frame, and are discharged with the refresh voltage at the end of the frame. Thus, for half of the frame these rows experience the residual effects of a voltage of one polarity and for the other half of the frame (which may be the first half of the next frame) they experience the same effect from a voltage of the opposite polarity. The result of the differential aging effect is that any pattern on the screen which has been displayed continuously for an extended period of time is likely to remain as a faint image on a dark screen and thus constitute a source of visual background distortion.

SUMMARY OF THE INVENTION

The present invention provides a means for eliminating the differential aging effect in TFEL screens by staggering the timing of the refresh pulse with respect to the scanning of the row electrodes refresh pulse, as that term is used herein, refers to a pulse having a magnitude equal to that used to cause luminescense but of opposite polarity so as to remove accumulated charge on the panel once during each frame. It is applied simultaneously to all row electrodes. The invention includes a refresh pulse generator which may be programmed to generate a refresh pulse at variable times with respect to the time of energization of each of the row electrodes. Over a plurality of frames of data, the timing of the refresh pulses and the write pulses with respect to any given pixel will tend to be symmetrical, on the average. This is accomplished by stepping the generation of the refresh pulse in time in equal increments each frame. Thus, during the first frame, the refresh pulse may occur at the end of the frame and in subsequent frames it may advance to a temporal position three-quarters of the way into the frame, half-way through the frame, and so forth. Thus, the refresh pulse is applied at variable times within sequential frames advancing in equal increments which progress in a step-wise fashion either from the end of the frame to the beginning of the frame or vice versa.

In an alternative embodiment of the invention, the refresh pulse timing is held constant and the timing for the energization of the individual rows in a frame is made variable so that the order in which the rows are energized is continuously changed from frame to frame. Over a long enough period of time, the result will be that each pixel will experience the same average time asymmetry between write and refresh pulses.

Staggering the refresh pulse with respect to the timing of the write voltage pulses leads to one problem. As the refresh pulse is stepped past a write pulse for a particular row, the pixels in that row will experience two refresh pulses without an intervening write pulse. This may cause a dark line to appear on the screen, and in such cases it is necessary to provide a compensation pulse for that particular row electrode to adjust the level of luminescense in that row. The amplitude of the compensation pulse must be lower than that of the write pulse which immediately follows it, in order to avoid excessive brightness on that particular row. It has been found that the compensation pulse should have an amplitude sufficient to provide half of the light output of a write pulse.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 4(*a*) is a block schematic diagram of the controller illustrated in FIG. 4.

DETAILED DESCRIPTION OF THE INVENTION

Figure 1:
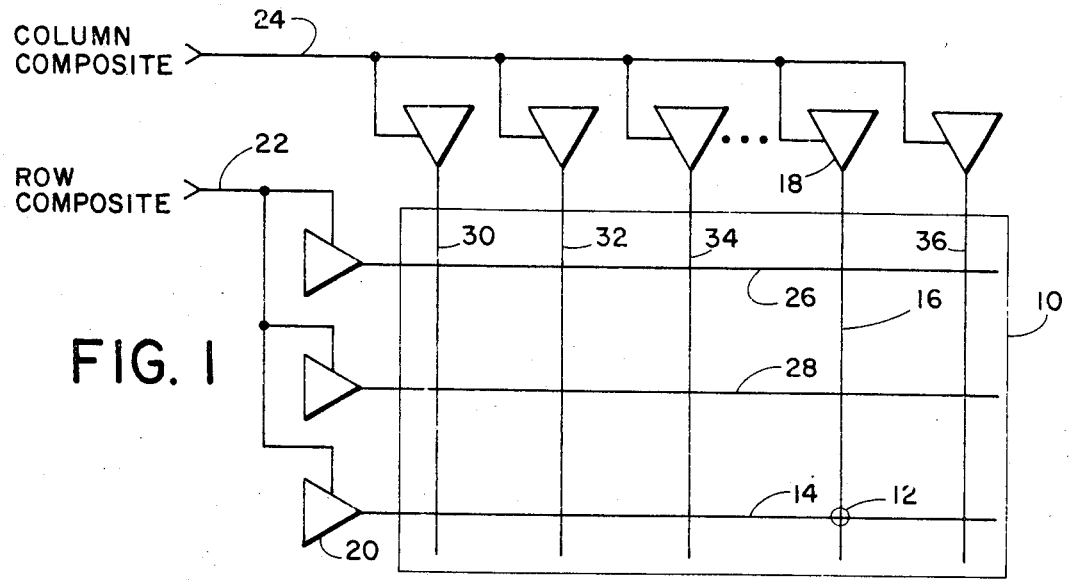
FIG. 1 is a schematic diagram of conventional driving architecture for a TFEL panel.

A TFEL, panel 10 is illustrated in FIG. 1 which shows conventional driving architecture. A pixel 12 is formed at the intersection of a row electrode 14 and a column electrode 16. The electrode 16 is driven by a column driver 18 and the row electrode 14 is driven by a row driver 20. Logic circuitry (not shown) provides signals for the row drivers and column drivers on lines 22 and 24, respectively.

Figure 1A:
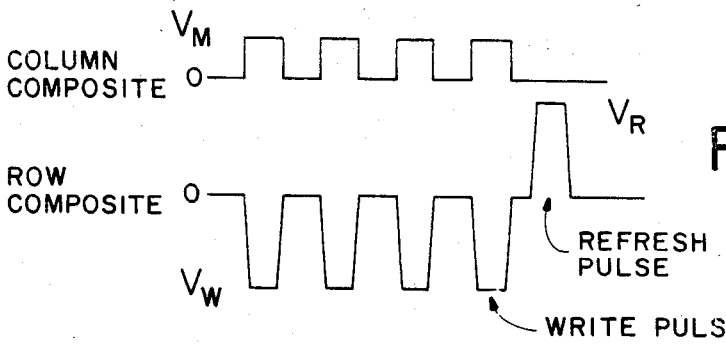
FIG. 1A is a wave form diagram illustrative of one conventional method of driving the panel of FIG. 1.

Referring now to FIG. 1A, row electrodes 26, 28 and 14 are shown as driven by a row composite voltage which comprises a series of write pulses labeled $V_w$. At the same time the column electrodes 30, 32, 34, 16 and 36 are driven by a column composite voltage labeled $V_m$. After all of the rows have been scanned with the pulses $v_w$, a refresh pulse $v_R$ is provided simultaneously to all of the row electrodes 26, 28 and 14. There may be, for example, 256 row electrodes together with their associated drivers and 512 column electrodes for a typical TFEL panel 10.

Figure 2:
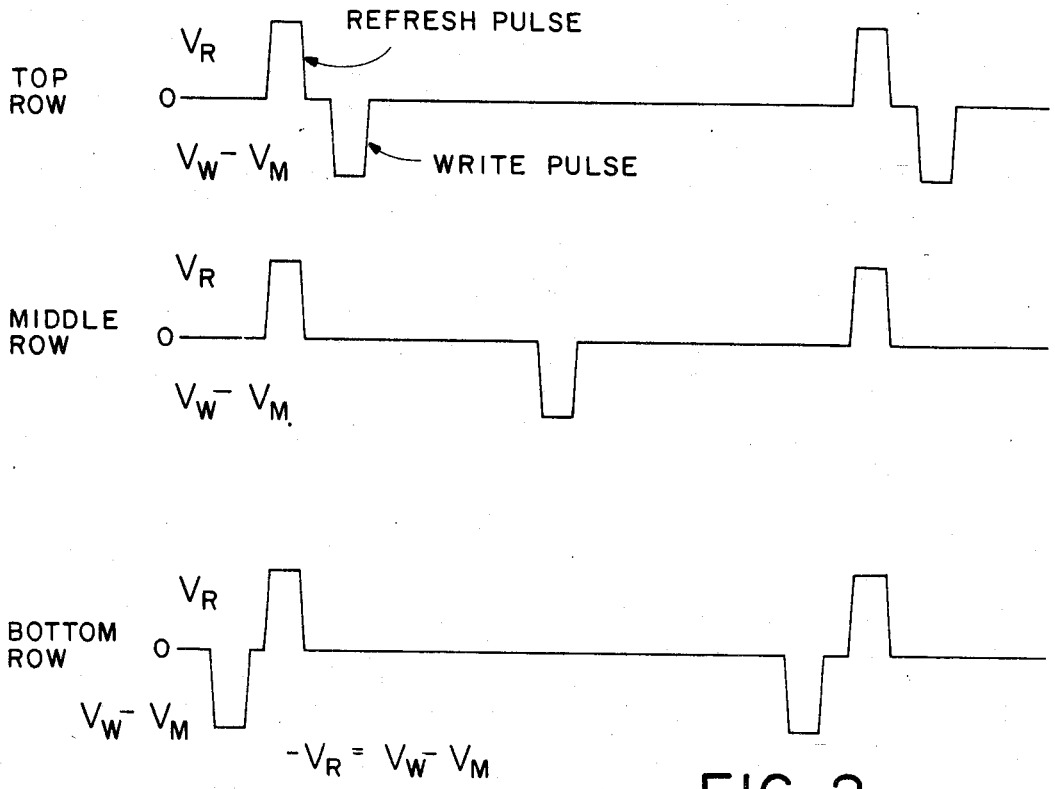
FIG. 2 is a wave form diagram which illustrates the affect on pixel voltage of a non-staggered refresh pulse.

FIG. 2 illustrates the time asymmetry between the write and refresh pulses for the top and bottom rows, as opposed to the symmetrical wave form illustrated for the middle row. Using the driving architecture of FIG. 1, the write/modulation ($V_w-V_m$) pulses for pixels in the top and bottom rows occur temporally adjacent to the refresh pulse. There is a relatively long period of time between these pulses and the next refresh pulse for both these sets of pixels. By contrast the pixels in the middle row experience a nearly symmetrical charging and discharging. It is the asymmetrical waveform, at the top and bottom of the panel 10 that produces the differential aging effect described above.

Figure 3:
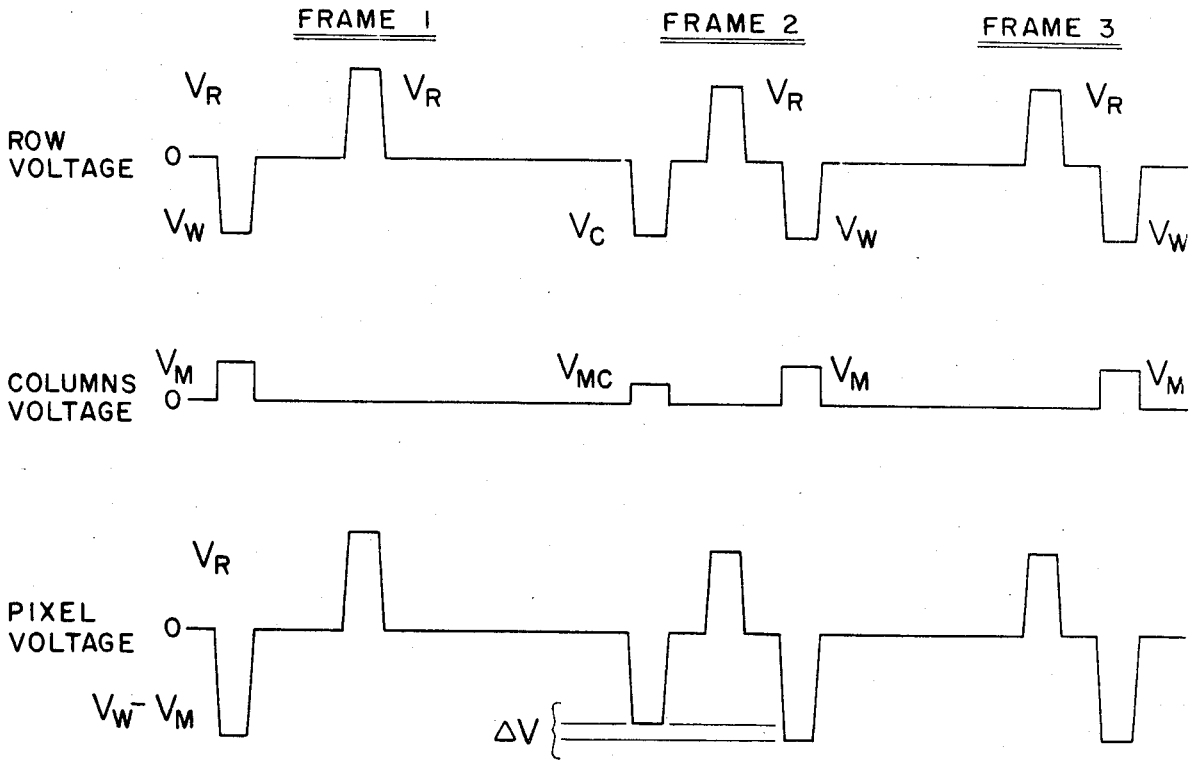
FIG. 3 illustrates one embodiment of the invention in which the refresh pulse is staggered with respect to the write pulses.

FIG. 3 illustrates for one arbitrary pixel the driving waveforms for one embodiment of the invention designed to alleviate the differential aging effect. (Since the waveforms in FIG. 3 represent the effect of a lit pixel, the column voltages $V_m$ are coincident in time with the write voltages $V_w$.) The refresh pulses $V_R$ are staggered in time with respect to the sequential scanning of the rows with the write voltage pulses $V_w$. Thus, in frame 1, $V_w$ leads $V_R$. In frame 2, however, the timing of the refresh pulse has been shifted with respect to the scanning of the particular row of interest and this time $V_R$ lags $V_w$ (and, hence, $V_w-V_m$). A compensation pulse $V_c$ is also provided, the effect of which will be explained below. In frame 3 $V_R$ is further staggered in time with respect to $V_w$.

A compensating voltage applied to the column electrodes $V_{mc}$ is applied coincident in time with the compensating voltage on the rows $V_c$. The effect on a pixel is shown in the bottom-most waveform of FIG. 3. It should be noted that the light emission which is proportional to $V_c-V_{mc}$ is less than that produced by $V_w-V_m$. This differential is represented as $\Delta V$.

The compensation pulse $V_c-V_{mc}$ is necessary due to the fact that between frame 1 and frame 3 the refresh voltage is stepped past the write voltage pulse so that two refresh voltage pulses would occur in sequence without an intervening write voltage pulse. The function of the compensating pulse, $V_c$ in combination with the column pulse $V_{mc}$, is to provide enough light output during this transitional phase to prevent a dark line from appearing on the screen which would otherwise be caused by the sequential application of the two refresh pulses to the same row electrode without an intervening write voltage pulse. The compensating voltage pulse $V_c-V_{mc}$ is of reduced amplitude as compared to $V_w-V_m$ so as to balance the excessive darkening of the screen without causing a bright line to appear.

Figure 6:
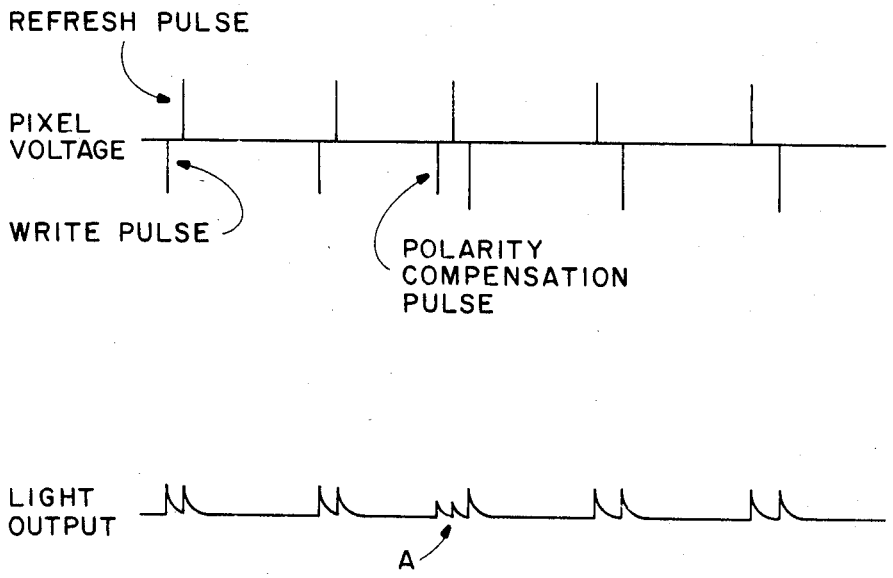
FIG. 6 is a waveform diagram illustrating the effect on pixel light resulting from use of the circuit of FIG. 5.

It is a property of TFEL screens that lit pixels respond to refresh pulses by emitting light but only to the extent that the pixel was originally charged. FIG. 6 illustrates this concept showing that there is light output from a pixel as a result of a write pulse and again as a result of the refresh pulse which is later in time. The light output resulting from the refresh pulse is equal in amplitude to that caused by the write pulse. If, instead of a write pulse, a polarity compensation pulse is utilized between two adjacent refresh pulses, a low amplitude light output is generated. The same low amplitude output is generated by the refresh pulse. If the amplitude of the polarity compensation pulse is such that it causes the pixel to emit approximately half the light as would be emitted by the normal write pulse, there will be three light output pulses in quick sequence from those pixels in the row in which the refresh pulse is stepped past the write pulse. To the viewer, however, the light output will appear to be the same because, the eye responds to the total light output over a period of time that is much longer than the widths of the pulses driving the TFEL panel. Thus, the group of pulses at the center of the light output line, comprising two pulses whose amplitude is half of that of the following pulse, will appear to the eye to have the same intensity as the other pulse groups of two pulses each.

Figure 4:
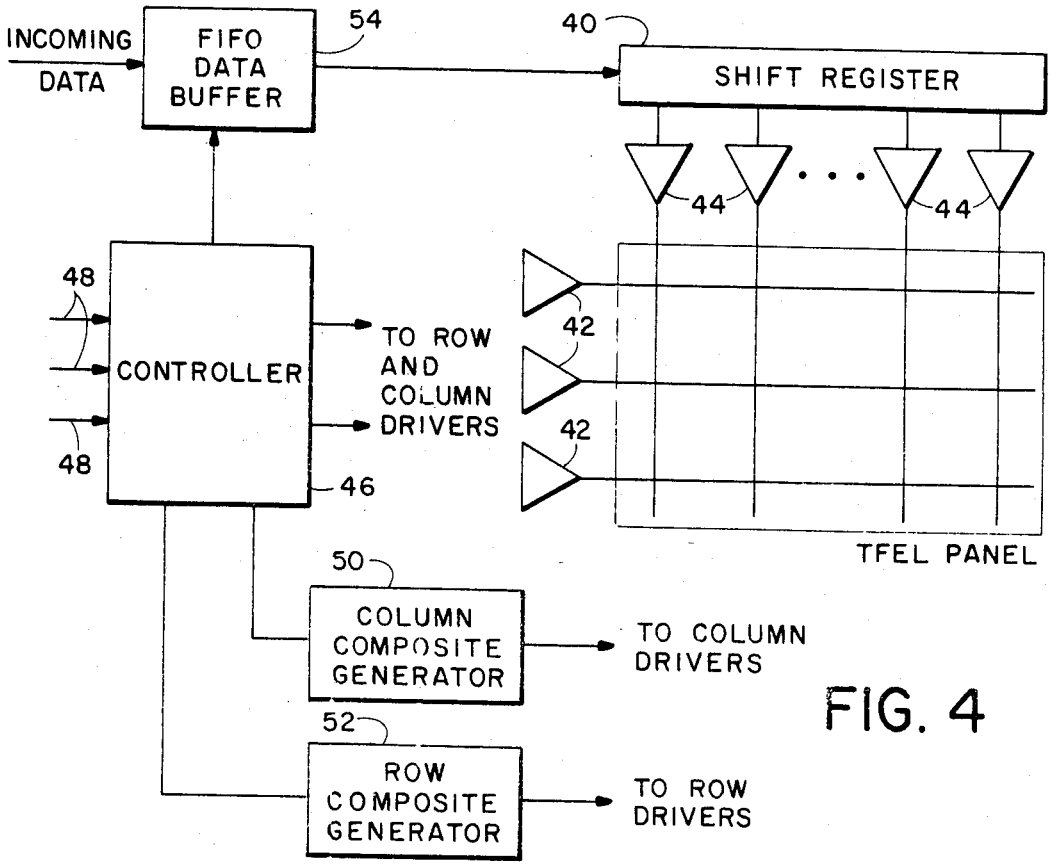
FIG. 4 is a block schematic diagram of driving architecture of a TFEL panel which implements the wave forms of FIG. 3.
Figure 4A:
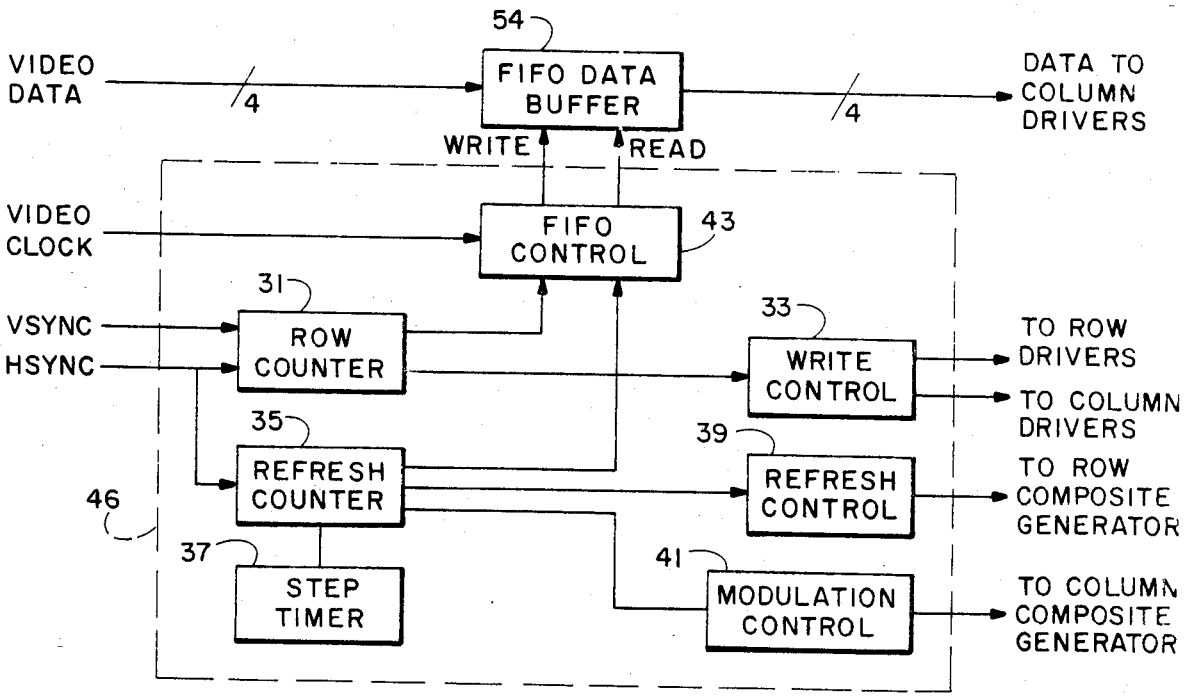

A schematic block diagram of a circuit for implementing the waveforms illustrated in FIGS. 3 and 6 is shown in FIG. 4. A shift register 40 holds one line of data; that is, as the row drivers 42 are sequentially strobed, the contents of the shift register 40 are provided to column drivers 44. The strobing of the row drivers 42 and the providing of the refresh pulses at variable times with respect to the particular row being scanned, is under the control of controller 46. The controller 46 is linked to an external computer or data processing system by interface signaling lines **48*a*, 48*b*, and 48*c* which may comprise horizontal and vertical synchronization and a video clock, respectively. Controller 46 is also connected to column composite generator 50 and row composite generator 52. These generators provide high voltage pulses for the column drivers 44 and row drivers 42**.

Since the refresh pulse is incrementally shifted in time once per frame, it occurs in the middle of the frame at a time when lines of data would normally be written. Tne width of the refresh pulse is such that it requires the same amount of time that would normally be taken to write three lines of data. Thus, the scanning of the row drivers 42 and the simultaneous generation of modulation pulses from the shift register 40 must be halted temporarily to accommodate the refresh pulse. Since data is being provided at a continuous rate, it must be held in a FIFO data buffer 54 and delayed while the refresh pulse is being applied to the screen. The buffer 54 is of the first-in, first-out type which has a depth of approximately three lines of data. Thus, when a refresh pulse is to be applied to the screen, the controller 46 instructs the data buffer 54 to stop its output to the shift register 40 and to accumulate lines of data. When the refresh pulse is turned off the data buffer supplies the delayed data lines to the shift register 40 on a first-in, first-out basis.

The controller 46 of FIG. 4 is shown in more detail in FIG. 4(*a*). A row counter 31 is responsive to vertical and horizontal synchronization signals on lines 48*b* and 48*a* respectively to keep track of the row which is currently being written. This counter is incremented by one after scanning a row and controls the writing of the panel which is scanned one row at a time from the top to the bottom of the screen 10. The output of the counter is applied to the write control 33 which in turn provides the controlling signals for the row and column drivers. A refresh counter 35 controls the positon in time of the refresh pulse relative to the row being scanned. Refresh counter 35 normally counts at the same rate as row counter 31. A step timer 37 periodically applies a signal to the refresh counter 35 which causes this counter to count by one row less than the previous frame. This causes the refresh pulse to occur one row in time sooner than the previous refresh pulse. Depending upon how the step timer is programmed, the refresh counter may advance sequentially, one frame at a time, or may remain stationary for several frames before advancing.

The outputs of the refresh counter 35 are provided to a refresh control 39 and a modulation control 41 which in turn provides signals to row and column composite generators 50 and 52 respectively. Additional outputs of row counter 31 and refresh counter 35 are applied to FIFO control 43 which in turn provides write and read signals for FIFO data buffer 54. FIFO control 43 is also responsive to a video clock input line. Until a refresh pulse occurs, video data passes straight through the FIFO data buffer 54 without being stored. When a refresh pulse occurs, however, the FIFO data buffer begins storing data and does so for three lines. After the refresh pulse is terminated, the data out of the FIFO data buffer 54 is read out at the same rate as the incoming data. However, since the refresh pulse has occurred the data being displayed is delayed by three lines to correspond with the row being scanned.

Figure 5:
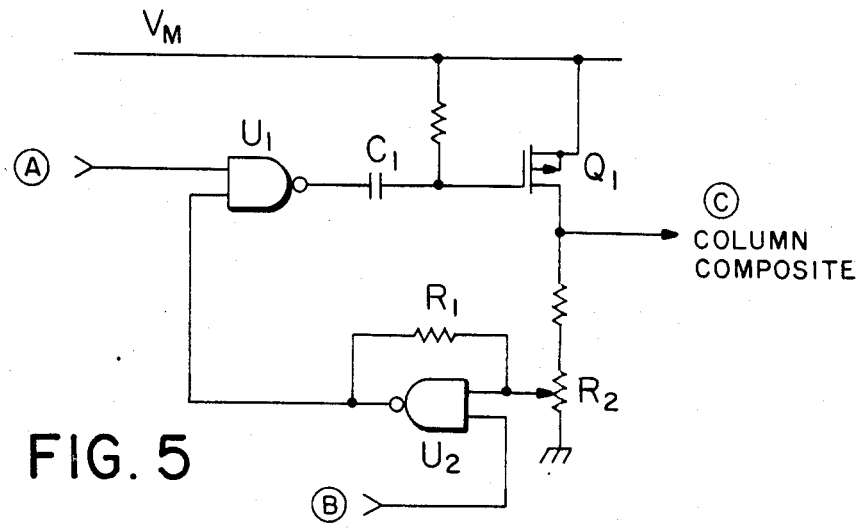
FIG. 5 is a schematic diagram of a circuit for controlling the column voltages for the panel illustrated in FIG. 4.
Figure 5A:
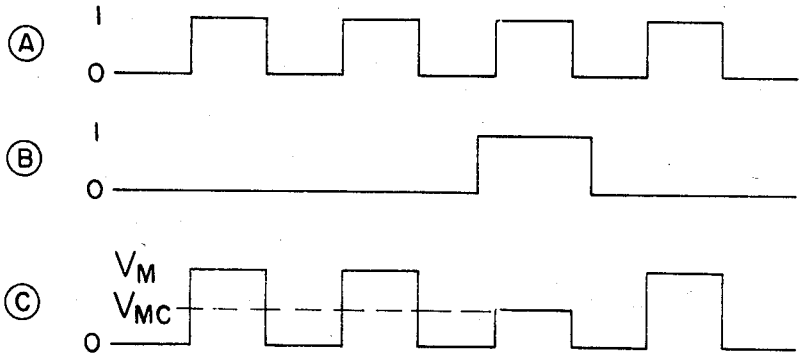
FIG. 5A is a waveform diagram illustrating the principle of operation of the circuit of FIG. 4.

FIG. 5 shows a circuit for implementing the column composite voltage necessary to produce the wave form shown in the column voltage line of FIG. 3. This wave form is essentially that shown in line C of FIG. 5A. In FIG. 2 CMOS devices U1 and U2 provide a negative feedback path for Q1. Although they are shown as logic devices in FIG. 5, U1 and U2 function as analog amplifiers in this configuration. A suitable CMOS device for performing this function is a model number 74HCOO manufactured by Signetics Corporation. Q1 is a switch for the driving voltage Vm. Q1 is normally controlled by the output of U1 which is in turn controlled by the waveform at A. When the input to B at U2 goes high, U2 is turned on and thus samples the output signal at C. This provides a linear negative feedback signal through U1 to the gate of Q1 to control the amplitude of the output at C. Resistor R1 is a gain-reducing resistor which is necessary because the gain of U2 would ordinarily be too high for this application. C1 is a blocking DC offset capacitor. The height of the pulse $V_{mc}$ is set by the variable potentiometer R2. $V_{mc}$ combines with the write compensation pulse $V_c$ to provide a pulse that gives a low level light output as shown in FIG. 6. The timing of the input at B is controlled by controller 46 and is timed to occur just before a refresh pulse which has been stepped past the timing of the write pulse on a particular row.

Figure 8:
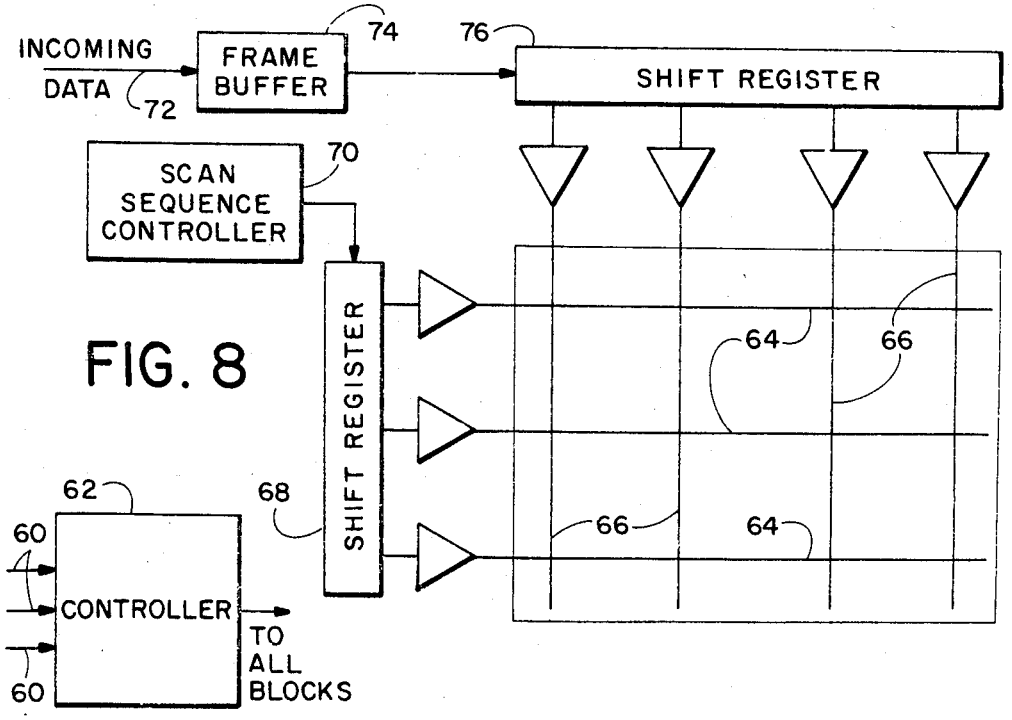
FIG. 8 is a block schematic diagram of driving architecture for a TFEL panel for implementing the row scanning sequence in FIG. 7.
Figure 7:
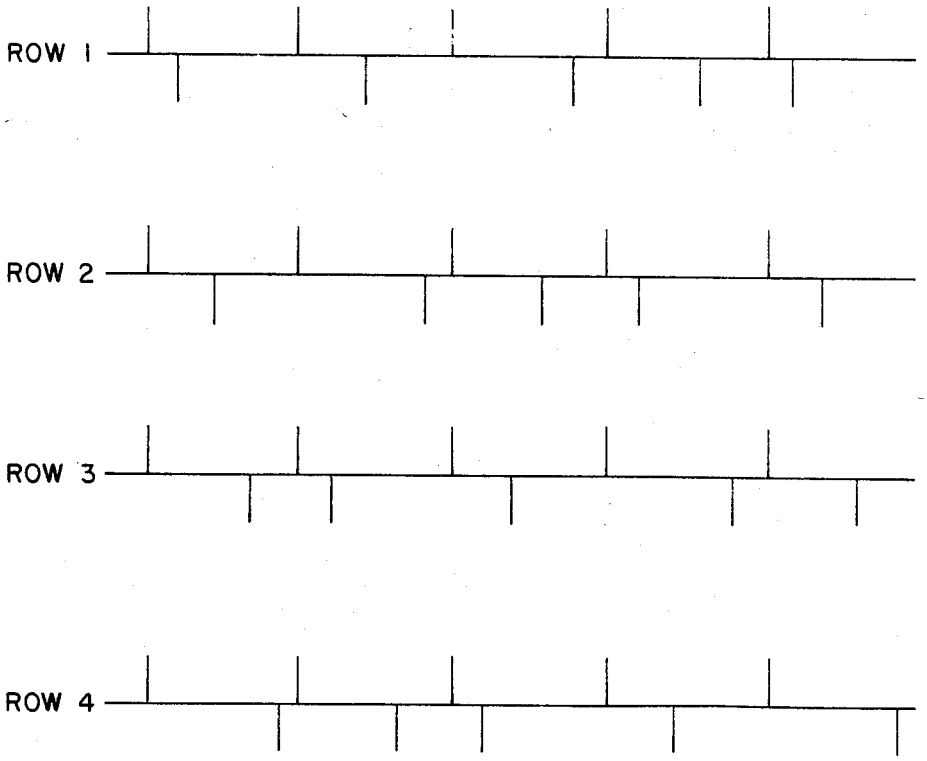
FIG. 7 is a waveform diagram illustrating an alternative method of implementing the invention by altering the row scanning sequence.

An alternative embodiment of the invention is shown in FIGS. 7 and 8. FIG. 7 illustrates the method of operation of the alternative embodiment. Normally the rows are scanned in sequence one after another, usually beginning at the top of the screen and proceeding towards the bottom. FIG. 7 illustrates, however, that the rows may be scanned according to a variable sequence in which the sequence is altered each frame. According to this method, the refresh pulse always occurs at the same time but the timing of the scanning of any particular row is varied with respect to the refresh pulse, so that on average, no particular row experiences any more time asymmetry with respect to the refresh pulse than any other row. The block diagram of FIG. 8 illustrates the method of implementing the sequential scanning of FIG. 7.

Referring now to FIG. 8, this schematic diagram shows a circuit for implementing the scanning sequence shown in FIG. 7. Interface signal inputs 60 are connected to a controller 62 which contains all of the logic circuitry necessary to control the timing of pulses applied to the row and column electrodes 64 and 66, respectively. The row electrodes 64 are driven by a shift register 68 which in turn is driven by a scan sequence controller 70. The incoming data line 72 is connected to a frame buffer 74 which controls a shift register 76. The scan sequence controller 70 controls the order in which the rows are energized with a write pulse during each data frame. Thus, 256 times per frame the scan sequence controller loads a digital code into the shift register which designates one of the row electrodes 64 to be energized. The sequence of energization of the row electrodes 64 is chosen such that on the average, all of the row electrodes experience the same degree of time asymmetry with respect to the timing of the refresh pulse.

Throughout this application it has been assumed that the row electrodes are to be used as scanning electrodes and that data is entered on the column electrodes. There is, however, no particular requirement that the panel be illuminated in this manner, and it should be understood that the scanning and data functions could be switched between the row and column electrodes. Similarly, use of the invention herein does not depend upon which set of electrodes is supplied with the refresh pulse, since it is necessary only to supply this pulse to the screen at times which vary with respect to whichever set of electrodes performs the scanning or preconditioning of the screen in anticipation of data pulses supplied to the other set of electrodes.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. In a TFEL panel having a first plurality of scanning electrodes and a second plurality of data electrodes, said first and second pluralities of electrodes being orthogonally disposed with respect to each other and forming a matrix of pixels, the combination comprising:

(a) means for selectively energizing each of said scanning electrodes one at a time until all such electrodes have been energized so as to complete a frame of data;

(b) means for selectively energizing certain ones of said data electrodes simultaneously with the energization of each of said scanning electrodes so as to illuminate selected pixels within said matrix; and (c) refresh pulse generator means for generating a refresh pulse once per frame of data during a time interval when no scanning electrode is energized, wherein said refresh pulse occurs at a different time during each sequential frame of data with respect to the energization of each of said scanning electrodes.

2. The combination of claim 1 wherein said scanning electrodes are sequentially energized in turn and the time of occurrence of said refresh pulse is varied from frame to frame.

3. The combination of claim 1 wherein the order in which the scanning electrodes are energized varies from frame to frame and the time of occurrence of said refresh pulse within each frame remains constant.

4. The combination of claim 2 further including polarity compensation pulse means for providing a compensating pulse opposite in polarity to said refresh pulse to compensate for the effect of sequential refresh pulses being supplied to a scanning electrode.

5. The combination of claim 4 wherein the amplitude of said compensation pulse is lower than that of a write pulse supplied to a scanning electrode.

6. The combination of claim 5 wherein said compensation pulse is applied to said scanning electrode at a time which is temporally adjacent to the occurrence of said refresh pulse.

7. The combination of claim 5 wherein the amplitude of the compensation pulse is adjusted to provide a pixel light output which is half of the light output provided by a write pulse.

8. The combination of claim 4 wherein said refresh pulse generator means includes means for incrementally shifting the timing of said refresh pulse once per frame of data.

9. The combination of claim 7 wherein the incremental shifting of the timing of the refresh pulse begins at a temporal position adjacent the time of occurrence of the energization of a scanning electrode at one extreme end of the screen and ends at a temporal position adjacent the time of occurrence of the energization of a scanning electrode at the other end of the screen.

10. The combination of claim 1 wherein said refresh pulse is applied to said scanning electrodes.

11. The combination of claim 4 wherein said compensation pulse is applied to said scanning electrodes simultaneously with the application of a second compensation pulse applied to said data electrodes.

12. In a TFEL screen having scanning electrodes which are energized according to a predetermined sequence, and having data electrodes which are selectively energized, a refresh pulse generator for providing refresh pulses at times which vary with respect to the times of energization of each of the scanning electrodes.

13. The refresh pulse generator of claim 12 wherein the predetermined sequence of energizing said scanning electrodes begins at an edge of the TFEL screen and proceeds sequentially towards an opposite edge of the screen.

14. The refresh pulse generator of claim 12 wherein the refresh pulses are provided at a fixed time relative to beginning of the predetermined sequence of energizing said scanning electrodes and said predetermined sequence varies from one frame of data to the next frame of data.

15. The refresh pulse generator of claim 12 wherein the scanning electrodes are row electrodes and the data electrodes are column electrodes.

* * * * *

UNITED STATES PATENT AND TRADEMARK OFFICE

CERTIFICATE OF CORRECTION

PATENT NO. : 4,691,144

DATED : September 1, 1987

INVENTOR(S) : Christopher N. King, et al.

It is certified that error appears in the above-identified patent and that said Letters Patent is hereby corrected as shown below:

| | |
|---|---|
| Col. 3, line 31 | Change "$v_W$" to --$V_W$-- |
| Col. 4, line 63 | Change "Tne" to --The-- |
| Col. 5, line 23 | Change "positon" to --position-- |

Signed and Sealed this

Ninth Day of August, 1988

*Attest:*

*Attesting Officer*

DONALD J. QUIGG

*Commissioner of Patents and Trademarks*